United States Patent [19]

Fricke et al.

[11] Patent Number: 4,557,827

[45] Date of Patent: Dec. 10, 1985

[54] ELECTROSTATIC FREE-FALL SEPARATOR WITH FEEDING ARRANGEMENT

[75] Inventors: Günter Fricke; Iring Geisler, both of Bad Hersfeld; Helmut Zentgraf, Burghaun, all of Fed. Rep. of Germany

[73] Assignee: Kali und Salz AG, Kassel, Fed. Rep. of Germany

[21] Appl. No.: 548,072

[22] Filed: Oct. 31, 1983

[30] Foreign Application Priority Data

Dec. 20, 1982 [DE] Fed. Rep. of Germany ..... 3247064

[51] Int. Cl.[4] ..... B03C 7/12

[52] U.S. Cl. ..... 209/127.4; 209/231

[58] Field of Search ..... 209/127 C, 128–131, 209/231, 244, 245, 254

[56] References Cited

U.S. PATENT DOCUMENTS

| | | | |
|---|---|---|---|
| 668,791 | 2/1901 | Blake et al. | 209/127 C |
| 724,679 | 4/1903 | Dolbear | 209/128 |
| 1,071,354 | 8/1913 | Schnelle | 209/130 |
| 2,782,923 | 2/1957 | Cook, Jr. et al. | 209/127 C |
| 3,143,492 | 8/1964 | Bullock | 209/127 C |
| 4,297,207 | 10/1981 | Singewald et al. | 209/127 C X |
| 4,326,951 | 4/1982 | Broz | 209/129 X |

FOREIGN PATENT DOCUMENTS

| | | | |
|---|---|---|---|
| 1174272 | 7/1964 | Fed. Rep. of Germany | 209/127 C |
| 1174273 | 7/1964 | Fed. Rep. of Germany | 209/127 C |
| 1174274 | 7/1964 | Fed. Rep. of Germany | 209/127 C |

*Primary Examiner*—Richard L. Chiesa

*Attorney, Agent, or Firm*—Michael J. Striker

[57] ABSTRACT

An electrostatic free-fall separator has a feeding arrangement located upstream of the separator for feeding of fine-particle material to be separated into the electrostatic free-fall separator, wherein the feeding arrangement is formed as a funnel with braking inserts of an electrically insulated material and has walls limiting at their lower edge a longitudinal outlet slot, wherein the funnel has an inlet which is formed by one wall portion which is parallel to the outlet slot and an opposite inclined guiding surface with a lower edge extending parallel to the one wall portion so as to limit simultaneously a passage leading to the outlet slot, and two substantially vertical electrodes are arranged below the passage at a distance from one another which is smaller than the width of the passage.

6 Claims, 4 Drawing Figures

ELECTROSTATIC FREE-FALL SEPARATOR WITH FEEDING ARRANGEMENT

BACKGROUND OF THE INVENTION

The present invention relates to an arrangement for feeding fine-particle materials to be separated to an electrostatic free-fall cutter.

Electrostatic methods of separation of fine-particle materials in free-fall cutters have, particularly for dry separation of powdered triboelectrically charged crude potassium salt, great technical importance. The electrostatic separation of crude potassium salt is described in "Chemie, Ingenieur, Technik" 53 (1981), p. 916.

The separation action of the electrostatic free-fall cutter is substantially improved when the free-fall speed of the particles of the material to be separated is braked shortly before the entrance into the electrostatic field. In the German Pat. No. 1,174,273, the braking of the particles of the material to be separated is obtained with an inlet funnel composed of an upper inclined part and a lower part limited by vertical walls. Braking devices formed as open semipipes are arranged in the lower part. The industrial utilization of this arrangement has shown that the material to be separated is braked, but it leaves the inlet funnel in form of individual streams. Since each of these individual streams contains a different quantity of the material to be separated, considerable variations in the flow of the material to be separated take place, which act in a disadvantageous manner on the electrostatic separation.

An arrangement for feeding fine-particle material to be separated to the electrostatic free-fall cutter has also been proposed in which the inlet funnel is formed with braking inserts and inclined walls with lower edges forming a small longitudinal rectangular outlet slot. One of the great walls is inclined to the opposite vertical wall which is provided with inclined downwardly directed guide elements. Finally, a wedge-shaped strip having an upper horizontal surface is arranged at their lower edge and extends into the outlet slot. In this arrangement the material to be separated flows with formation of two fogs out of the arrangement, whereby a greater movement freedom of the particles of the material to be separated in the electric field of the free-fall cutter takes place.

However, it is advisable to further search for solutions which would improve the movement freedom of the particles of the material to be separated in the electric field toward the electrode corresponding to their charge and thereby to further improve the separation output, as compared with the known arrangements.

SUMMARY OF THE INVENTION

Accordingly, it is an object of the present invention to provide an arrangement for feeding of fine-particle material to be separated to an electrostatic free-fall separator and improvement of the feeding arrangements of the prior art.

In keeping with these objects and others which will become apparent hereinafter, one feature of the present invention resides, briefly stated, in an arrangement for feeding fine-particle materials to be separated to an electrostatic free-fall cutter, which is formed as a funnel with braking inserts of electrically insulating material and walls which limit at their lower edges a longitudinal rectangular outlet slot, wherein an inlet of the outlet slot is formed by one parallel vertical wall and an opposite inclined guiding surface of an electrically insulating material whose lower edge extends vertically and parallel to the vertical wall so as to limit therewith the longitudinal slot, and two vertical electrodes are arranged under the slot at a distance from one another somewhat exceeding the width of the longitudinal slot and end above the horizontal guiding surface.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF A PREFERRED EMBODIMENT

Figure 1:
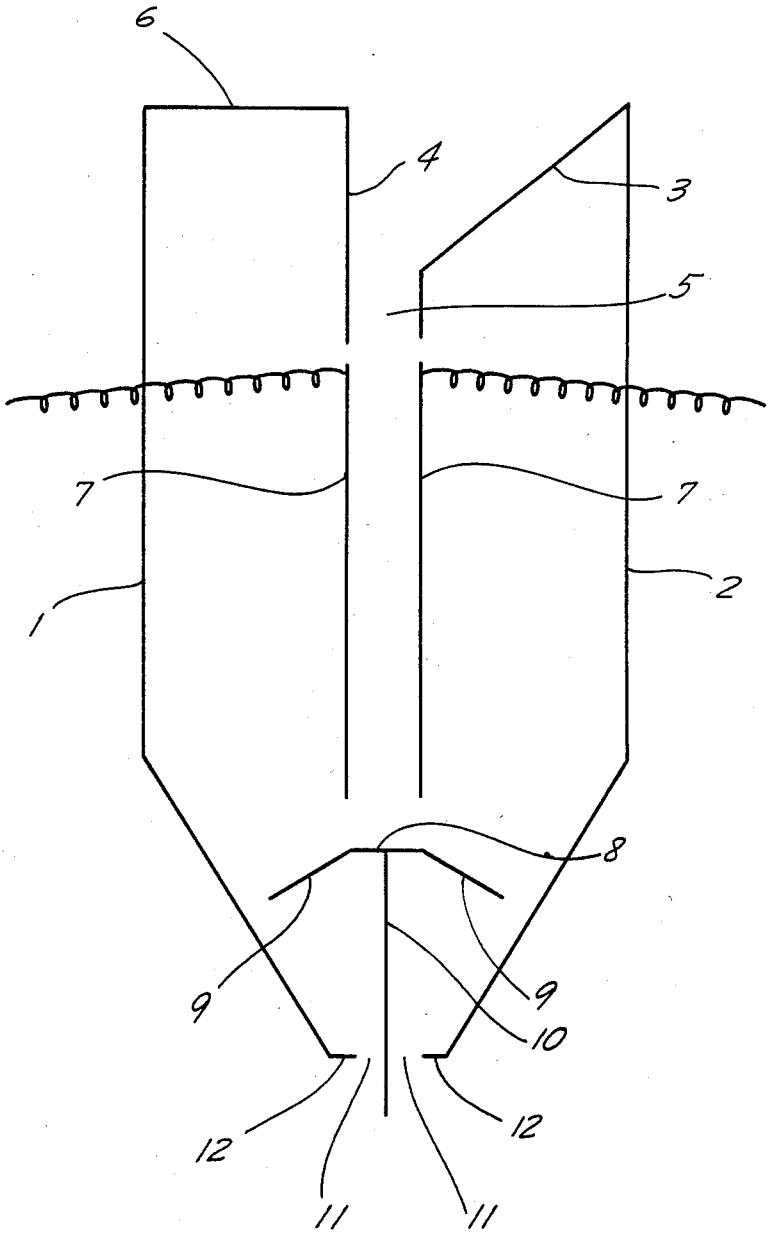
FIG. 1 is a view schematically showing a feeding device for fine-particle materials to be separated through an electrostatic free-fall cutter.

An arrangement for feeding of fine-particle material to be separated to an electrostatic free-fall cutter has a housing which includes longitudinal walls 1 and 2 with vertical portions in their upper region and inclined portions in their lower region. As inclined guiding surface 3 is arranged on one of the longitudinal walls and has a lower edge which extends normal and parallel to a vertical guiding surface 4. The vertical guiding surface 3 and the vertical guiding surface 4 form therebetween a small longitudinal slot 5.

The vertical guiding surface 4 is connected with the housing by a horizontal surface 6. Two electrodes 7, which can be formed also as vertical guiding surfaces, are located under the longitudinal slot 5 at a distance from one another. The distance between the electrodes 7 is only somewhat greater than the width of the slot 5. The electrodes 7 end somewhat above a horizontal guiding surface 8. Downwardly inclined guiding surfaces 9 are arranged at both free longitudinal edges of the guiding surface 8. The horizontal guiding surface 8 is mounted on an upper edge of a vertical guiding surface 10. The latter subdivides an outlet slot 11 in its center and extends downwardly beyond the outlet slot 11. The walls 1 and 2 each have at their lower end a strip 12 extending into the outlet slot 11 and having an upper horizontal surface.

The fine-particle material to be separated arrives via the guiding surface 3 into the funnel, strikes against the vertical downwardly extending guiding surface 4 and flows with reduced speed into the space between the electrodes. Here the particles of the material to be separated are deflected in correspondence with their charge to the oppositely charged electrode. The particle stream of the material to be separated leaves the intermediate space between the electrodes in a spread shape. The particles deflected between the electrodes reach the guiding surfaces 9 in accordance with their deflection. From there, they are guided on the inclined parts of the walls 1 and 2 and trickle down toward the strips 12. A movable layer of the material to be separated is formed on the lower horizontal surface of each strip 12. The particles from these movable layers discharge with a low initial speed, presorted in accordance with their charge as two homogeneous fogs parallel to the electrodes of the free-fall separator into the electrostatic field of the free-fall separator.

It has been recognized that the separation output of the subsequent electrostatic separation in the free-fall cutter is the best when the strength of the electrostatic field between the electrodes of the arrangement is between 6 kV/cm and 12 kV/cm.

The electrodes can be composed of materials which are conventional in the art. In accordance with a preferred embodiment of the invention, the electrodes are composed of aluminum foil, which is drawn off synthetic material and coated with a glass plate. With the exception of the electrodes, the entire arrangement is composed of an electrically insulated material. The corners and edges of the arrangement are advantageously rounded so as to avoid electrical sparkovers.

The feeding arrangement in accordance with the present invention operates so that the particles of the material to be separated are presorted already in the feeding device in accordance with their triboelectric charge and simultaneously braked.They leave the feeding device in two parallel fogs which impart to the particles the maximum movement freedom normal to the planes of this fog.

The electrodes of the free-fall cutter and the electrodes in the inventive arrangement must obviously be poled in the same manner, or in other words they must have the same polarity at the same side. When for example the positive polarity is in the feeding arrangement at the left side, it must also be at the left side in the free-fall separator, whereas the negative polarity in both steps must be at the right side. An electrode of the closer fog contains during the separation relatively more particles which are charged oppositely to this electrocde, so that these particles during their path in direction to the electrode is only little hindered by the oppositely charged particles and therefore their movability is increased.

The electrostatic separation is favorably influenced in the sense that both the residual fraction separated from the material and the intermediate fraction have a lower quantity of valuable material than with the use of the arrangement in accordance with the prior art.

The technical advantages of the inventive arrangement can be clear from the following examples. As the material to be separated, powdered crude potassium salt with a grain size of less than 1.25 mm is used. The comparison of the output in the Example 1 shows that, with the same quantity of residue, the residue obtained in accordance with the arrangement of the present invention has a lower $K_2O$ content than the residue obtained in the feeding device in accordance with the prior art. Moreover, the output of the Examples 1 and 2 shows that the same quantity of valuable substance-concentrate a valuable substance-concentrate is obtained with the use of the inventive arrangement has a considerably lower content of NaCl-impurities than a valuable substance-concentrate obtained with the feeding arrangement in accordance with the prior art.

EXAMPLE 1

The crude potassium salt has a $K_2O$ content of 9.12% and is composed of 12.50% by weight silvite, 7.22% by weight carnalite, 16.66% by weight kieserite, 62.44% by weight mineral salt and 1.17% by weight anhydrite. The crude potassium salt is conditioned with 75 g of salicylic acid/t and 20 g monochloro acetic acid/t at a relative moisture of 10%, for improving the triboelectric charging. The field strength in electrostatic free-fall cutter amounts to 4 kV/cm.

(a) in accordance with the invention

The triboelectrically charged crude potassium salt is supplied in a free fall to the inventive arrangement. The field strength between the electrodes of the inventive arrangement amounts to 8 kV/cm. The material to be separated flows being braked through the outlet slot of the arrangement in a free fall to the electrostatic field of the free-fall cutter.

At the foot of the cutter, in the vicinity of the negative electrode, 30% by weight of the quantity of the fed /material to be separated is contained as a residue with $K_2O$ content only 1.88%.

In the vicinity of the positive electrode, 25% by weight of the fed material to be separated is contained as a valuable substance-concentrate with NaCl content of only 15.5% by weight. cl (b) Comparison This was conducted with the use of preknown feeding device in accordance with Example (a). At the foot of the cutter in the vicinity of the negative electrode, 30% by weight of the quantity of the fed material to be separated is obtained as a residue with a $K_2O$ content amounting to 2.10%. In the vicinity of the positive electrode, 25% by weight of the quantity of the fed material to be separated is obtained as valuable substance-concentrate with a NaCl content of 19% by weight.

Figure 2:
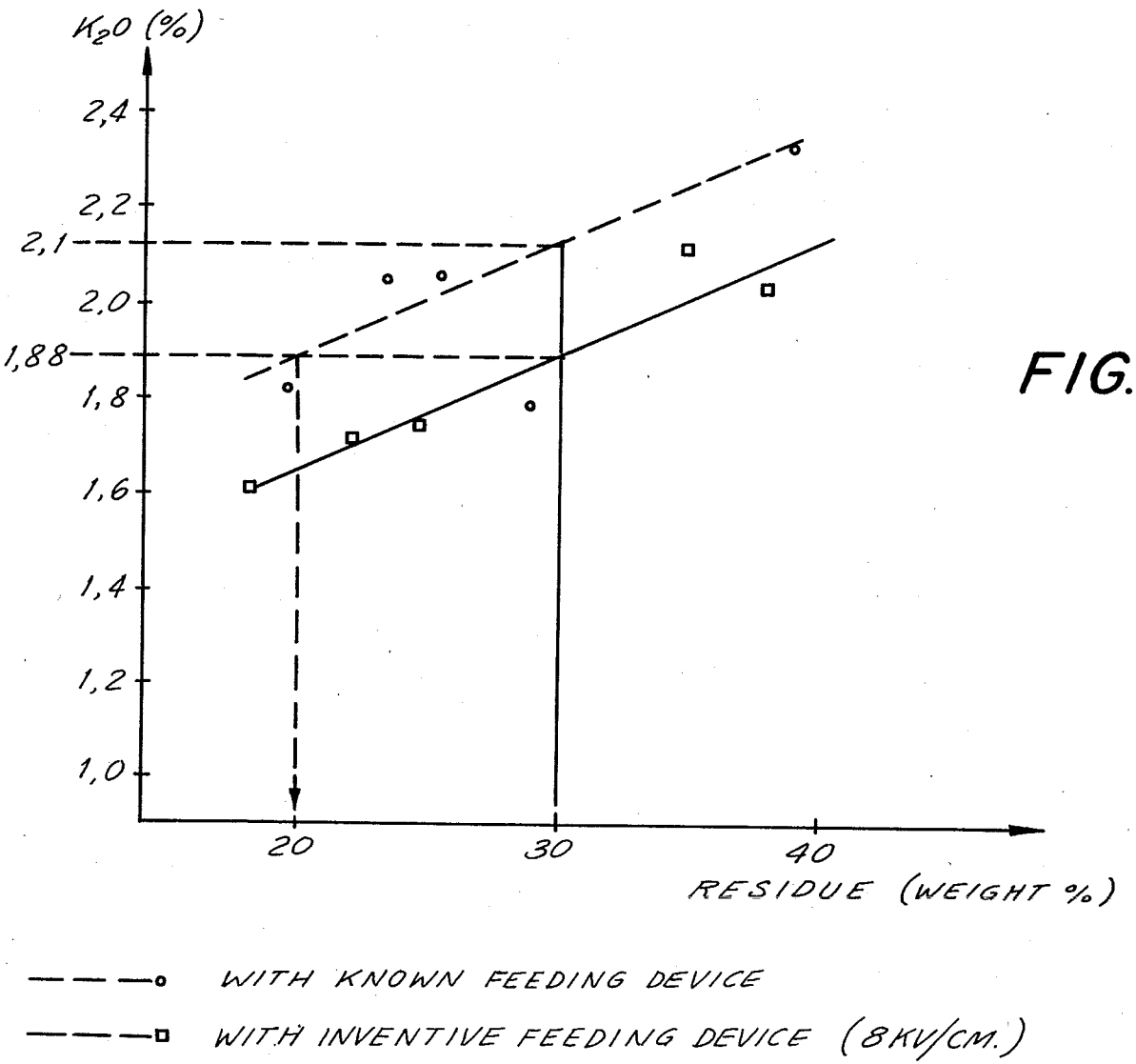
FIGS. 2–4 illustrate examples comparing the inventive feeding device with known feeding devices.
Figure 3:
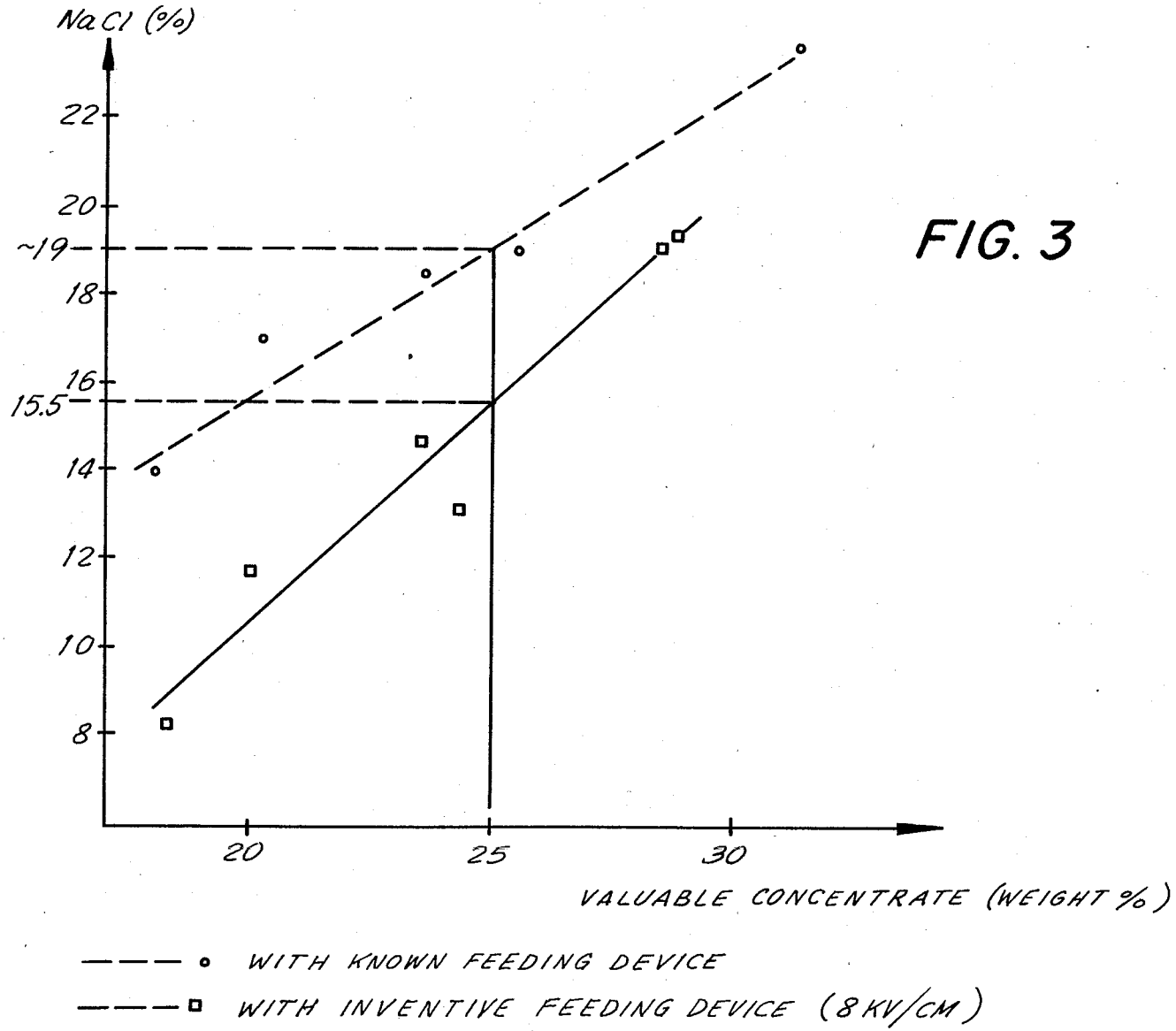

The results of analogous test rows are graphically shown in FIGS. 2 and 3.

The quantities of valuable substance-concentrate or residue indicated on the abscissa are given in accordance with the variation of the position of turnable guide sheets located under the electrodes of the free-fall cutter for separating the stream of the material.

EXAMPLE 2

The potassium preconcentrate has a $K_2O$ content of 23.41% and is composed of 30.94% by weight silvite, 22.78% by weight carnalite, 1.38% by weight kieserite, 44.34% by weight mineral salt and 0.54% by weight anhydrite. It is conditioned with 0.50 g of salicylic acid/t, 25 g of fatty acid/t and 100 g of water/t at a relative air moisture of 5%, for improving the triboelectric charging. The field strength in electrostatic free-fall cutter amounts to 4 kV/cm.

(a) in accordance with the invention

The triboelectrically charged potassium preconcentrate is supplied in a free fall to the inventive arrangement. The field strength between the electrodes of the inventive arrangement amounts to 6 Kv/cm. The material to be separated flows through the outlet slot of the arrangement in a free fall to the electrostatic field of the free-fall cutter.

At the foot of the cutter, in the vicinity of the positive electrode, 26% by weight of the quantity of the fed material to be separated is obtained as a valuable substance-concentrate with NaCl content only 8.2%.

(b) Comparison

This was conducted with the use of a preknown feeding device in accordance with Example (E). At the foot of the cutter in the vicinity of the positive electrode, 26% by weight of the quantity of the fed material to be separated is obtained as a valuable substance-concentrate with a NaCl content amounting to 9.3%.

Figure 4:
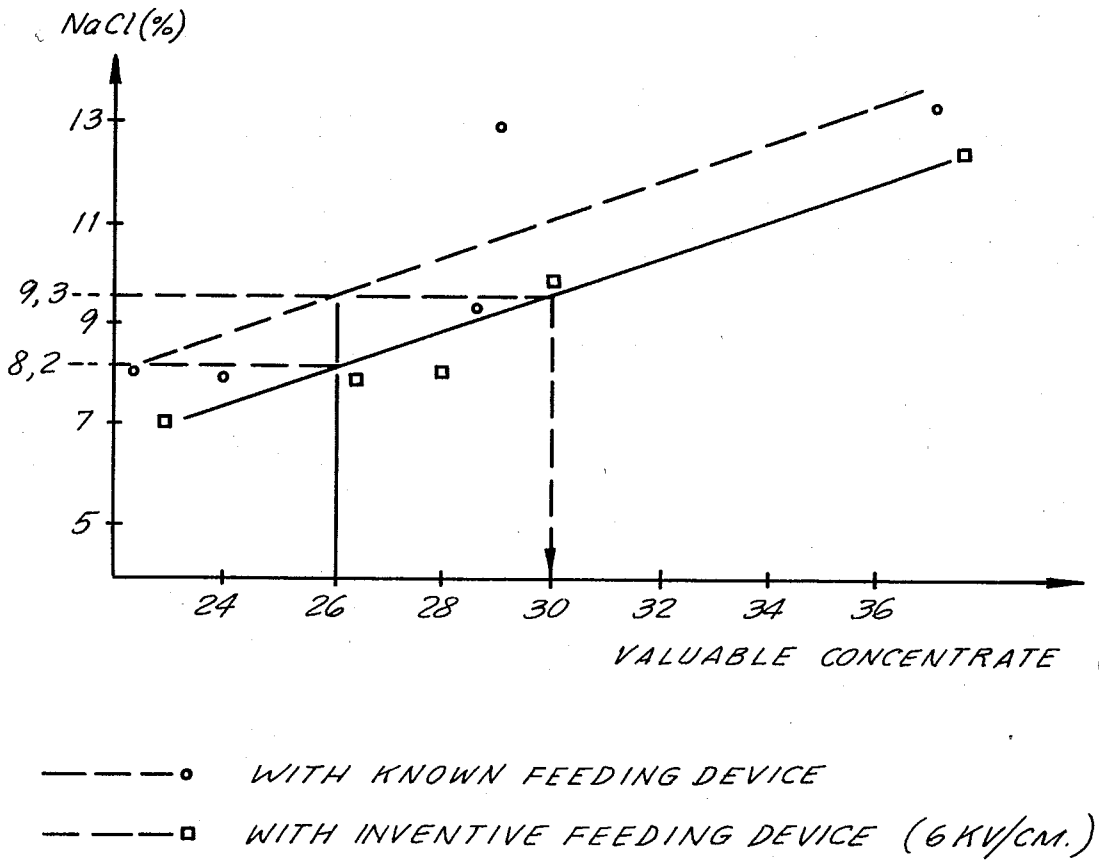

The results of analogous test rows are graphically shown in FIG. 4.

The quantities of valuable substance-concentrate indicated on the abscissa are given in accordance with the variation of the position of turnable guide sheets located under the electrodes of the free-fall cutter for separating the stream of the material.

It will be understood that each of the elements decribed above, or two or more together, may also find a useful application in other types of constructions differing from the types described above.

While the invention has been illustrated and described as embodied in an arrangement for feeding fine-particle materials to be separated to an electrostatic free-fall cutter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspcts of this invention.

What is claimed as new and desired to be protected by Letters Patent is set forth in the appended claims.

1. An electrostatic free-fall separator, comprising a feeding arrangement located upstream of said separator for feeding fine-particle materials to said electrostatic free-fall separator, said feeding arrangement comprising a housing having two substantially vertical walls with lower edges defining an outlet slot; means forming an inlet of said housing and including a first substantially vertical wall portion and a guiding surface located opposite to said first wall portion and inclined thereto so as to form a funnel, said inclined guiding surface having a lower edge which extends substantially vertically and is formed as a substantially vertical second wall portion which is parallel to said first wall portion and limits together with the latter a longitudinal passage of a predetermined width so that a fine-particle material to be separated arrives over said guiding surface into said funnel, strikes against said first wall portion and flows through said longitudinal passage downwardly; two electrodes located under said passage and relative to one another at a distance which is somewhat greater than the width of said longitudinal passage so that the particles of the material exiting said longitudinal passage are deflected in correspondence with their charge to a respective one of said electrodes and are thereby presorted; guiding means located under said electrodes and arranged to guide the material after leaving said electrodes in two separate partial streams in correspondence with the presorting between said electrodes; and braking means including two braking members located before said outlet slot so that before leaving the arrangement the separate partial streams form over said braking members two movable layers from which the particles are discharged, presorted in accordance with their charge and in the form of two homogeneous fogs, to be supplied with an electrostatic field of said electrostatic free-fall separator for subsequent separation in the latter.

2. An electrostatic free-fall separator as defined in claim 1, wherein said first substantially vertical wall portion and said second substantially vertical wall portion are composed of an electrically insulated material.

3. An electrostatic free-fall separator as defined in claim 1, wherein said electrodes are composed of an electrically conductive material.

4. An electrostatic free-fall separator as defined in claim 1, wherein said guiding means includes a substantially horizontal further guiding surface located above said outlet slot and composed of an electrically insulating material, said electrodes being arranged above said substantially horizontal further guiding surface.

5. An electrostatic free-fall separator as defined in claim 1, wherein each of said longitudinal walls has a lowermost end, each of said braking members being arranged at said lowermost end of a respective one of said longitudinal walls and formed as a strip which extends into said outlet slot and has a substantially horizontal upper surface.

6. An electrostatic free-fall separator as defined in claim 1, wherein said guiding means includes a substantially vertical additional guiding surface which subdivides said outlet slot centrally and has an upper end provided with a substantially horizontal guiding surface whose free longitudinal edges are provided with downwardly inclined guiding surfaces, said guiding surfaces being composed of an electrically insulating material.

* * * * *